US008887800B2

(12) United States Patent
Havinga et al.

(10) Patent No.: US 8,887,800 B2
(45) Date of Patent: Nov. 18, 2014

(54) COIL TUBING RIG AND CARRIER SYSTEM

(75) Inventors: Richard D. Havinga, Okotoks (CA); Reginald Layden, Calgary (CA)

(73) Assignee: Xtreme Drilling and Coil Services Corp, Calgary (CA)

( * ) Notice: Subject to any disclaimer, the term of this patent is extended or adjusted under 35 U.S.C. 154(b) by 231 days.

(21) Appl. No.: 12/981,969

(22) Filed: Dec. 30, 2010

(65) Prior Publication Data

US 2012/0168179 A1 Jul. 5, 2012

(51) Int. Cl.
*E21B 19/22* (2006.01)

(52) U.S. Cl.
CPC ..... *E21B 19/22* (2013.01)
USPC ..... 166/77.1; 166/77.2

(58) Field of Classification Search
USPC ..... 166/75.11, 77.1, 77.2, 85.4, 77.3
See application file for complete search history.

(56) References Cited

U.S. PATENT DOCUMENTS

| | | | | | |
|---|---|---|---|---|---|
| 2,922,501 | A * | 1/1960 | Wilson | 175/203 |
| 3,942,593 | A * | 3/1976 | Reeve et al. | 173/186 |
| 4,129,079 | A * | 12/1978 | Shannon | 410/1 |
| 4,305,237 | A * | 12/1981 | Borg et al. | 52/116 |
| 4,390,192 | A | 6/1983 | Wagner | |
| 5,842,530 | A * | 12/1998 | Smith et al. | 175/162 |
| 6,516,892 | B2 * | 2/2003 | Reilly | 166/384 |
| 6,994,171 | B2 * | 2/2006 | Orr et al. | 173/28 |
| 7,182,140 | B2 | 2/2007 | Wood | |
| 7,185,708 | B2 | 3/2007 | Wood et al. | |
| 7,357,616 | B2 * | 4/2008 | Andrews et al. | 414/332 |
| 7,469,755 | B2 * | 12/2008 | Borst et al. | 175/172 |
| 7,549,468 | B2 * | 6/2009 | Pleskie | 166/77.2 |
| 7,600,585 | B2 * | 10/2009 | Patton et al. | 175/57 |
| 7,628,229 | B2 * | 12/2009 | Wood et al. | 175/203 |
| 7,640,999 | B2 * | 1/2010 | Patton | 175/57 |
| 7,810,554 | B2 * | 10/2010 | Wood et al. | 166/77.2 |
| 8,047,303 | B2 * | 11/2011 | Donnally et al. | 175/57 |
| 2004/0206551 | A1 * | 10/2004 | Carriere et al. | 175/203 |
| 2005/0247456 | A1 * | 11/2005 | Wise et al. | 166/384 |
| 2007/0215359 | A1 * | 9/2007 | Wood et al. | 166/379 |

OTHER PUBLICATIONS

Qu Jinfang; State Intellectual Property Office of the People's Republic of China; First Office Action; Oct. 11, 2010; 7 pages; Haidian District, Beijing, China.

* cited by examiner

*Primary Examiner* — Kenneth L Thompson
(74) *Attorney, Agent, or Firm* — Bushman Werner, P.C.

(57) ABSTRACT

A coil tubing rig (12) is supported on a carrier trailer (24) in transit and during rig operations. A plurality of a hydraulic tracks (30), (32) each connected to the carrier trailer may be activated to raise and lower the carrier trailer from the loading position to a rig operating position. A dolly assembly including a plurality of wheels supports the carrier trailer during transit, and hydraulic jacks both incline the carrier trailer to a rig loading/unloading position such that a front end of the carrier trailer is substantially at ground level, and raise the rig to a desired elevation for conducting rig operations.

26 Claims, 6 Drawing Sheets

COIL TUBING RIG AND CARRIER SYSTEM

FIELD OF THE INVENTION

The present invention relates to coil tubing rigs and, more particularly, a coil tubing rig and transportation system for moving the coil tubing rig from one location to another location.

BACKGROUND OF THE INVENTION

Coil tubing rigs are commonly used in oil and gas applications, in drilling, completion and workover activities. Furthermore, coil tubing rigs are commonly used in the drilling of mining borehole, methane bed gas boreholes, water wells, and other earth boreholes.

With particular reference to the use of coil tubing rigs in operations involving oil and gas wells, whether the activities are drilling, completion or workover, rig cost per day becomes an important factor. Coil tubing rigs have gained great popularity, particularly in the drilling of the oil and gas wells because they are much faster on average than a conventional rig employing jointed pipe. Due to the high cost of operations involving drilling, completing and re-entry work in oil and gas wells, there is increased emphasis in reducing the number of days a rig is on a site to perform a given operation, e.g, drilling. Further, where multiple wells are being drilled in a relatively localized geographical area, fast transport of the coil tubing rig from one site to another site becomes important to contain costs.

SUMMARY OF THE INVENTION

The system of the present invention comprises of a coil tubing rig and a rig carrier. The carrier comprises a trailer frame and a dolly assembly connected to the frame. The coil tubing rig is removably positionable on the trailer frame. A plurality of hydraulic jacks each connected to the carrier trailer are activated to raise and lower that carrier trailer from a rig loading/unloading position to a rig operating position. In a rig loading/unloading position, a front end of the carrier trailer is substantially at ground level while the rear end of the carrier trailer is elevated.

These and further features and advantages of the present invention will become apparent from the following detailed description, wherein reference is made to the figures in the accompanying drawings.

DETAILED DESCRIPTION OF PREFERRED EMBODIMENTS

Figure 1:
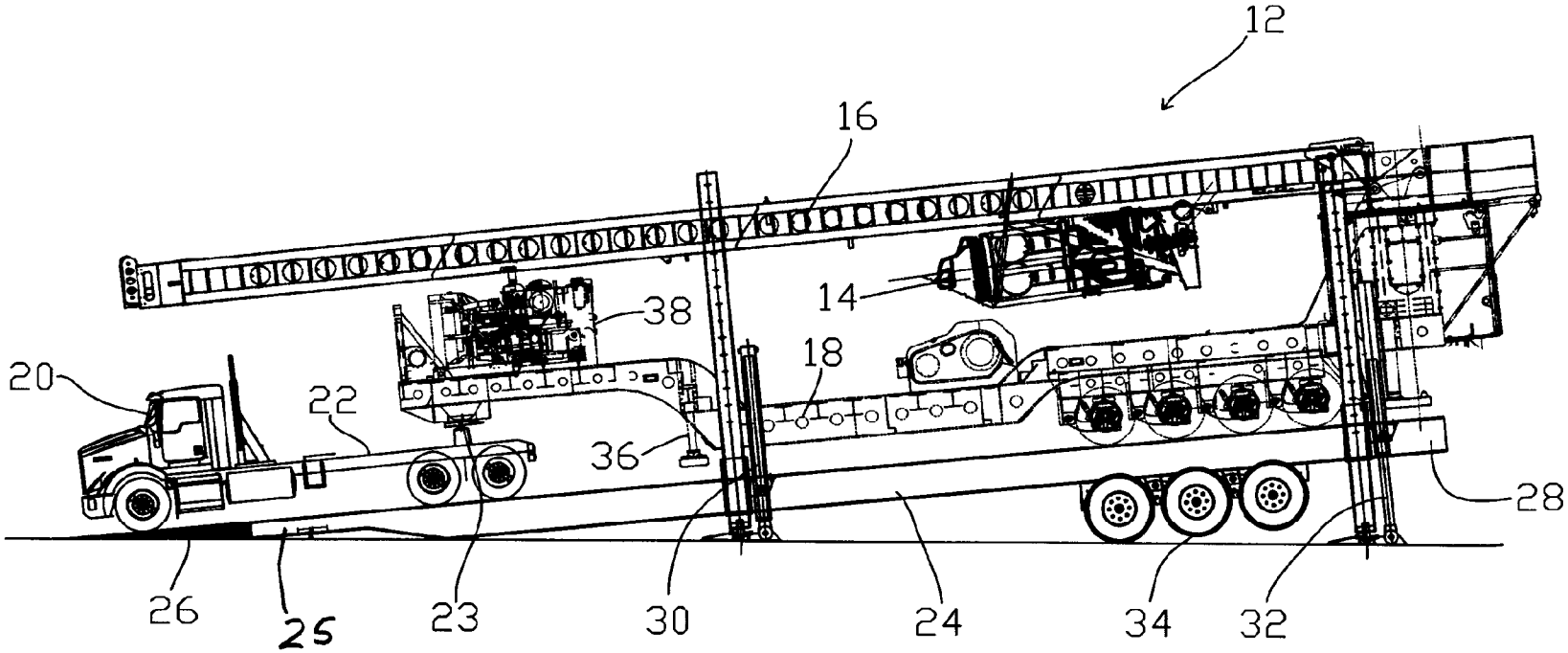
FIG. 1 is a side elevation view showing a coil tubing rig and a rig carrier as the coil tubing rig is loaded onto the rig carrier.

Referring to FIG. 1, coil tubing rig 12 comprises a coil tubing injector 14, and mast 16, and wheeled trailer 18. In other embodiments, a top drive may be provided movable along the mast to conduct jointed pipe operations. Wheeled trailer 18 is connected to a tractor 20 having a bed 22 and a connector, e.g., a fifth wheel connector 23, to which the tongue of trailer 18 may be attached. As shown, coil tubing injector 14 is connected to a mast 16 which may be pivoted from the transport position as shown in FIG. 1 to a transverse position, e.g., vertical, for conducting coil tubing operations. An engine and a hydraulic power source 38 may be positioned at the front end of trailer 18. The various hydraulic cylinders disclosed herein may thus receive power from source 38. A rig carrier trailer comprises a frame 24 and a dolly assembly 34, and is structurally separate from the wheeled trailer 18.

As shown in FIG. 1, frame 24 of the carrier trailer has a front or first end 25 and a rear or second end 28. As shown in FIG. 1, front end 25 has been lowered relative to the elevated rear end 28 such that front end 25 rests on the ground or other support surface. In this inclined position, rig 12 including trailer 18 may be moved by tractor 20 up frame 24 to a desired position on frame 24.

Figure 2:
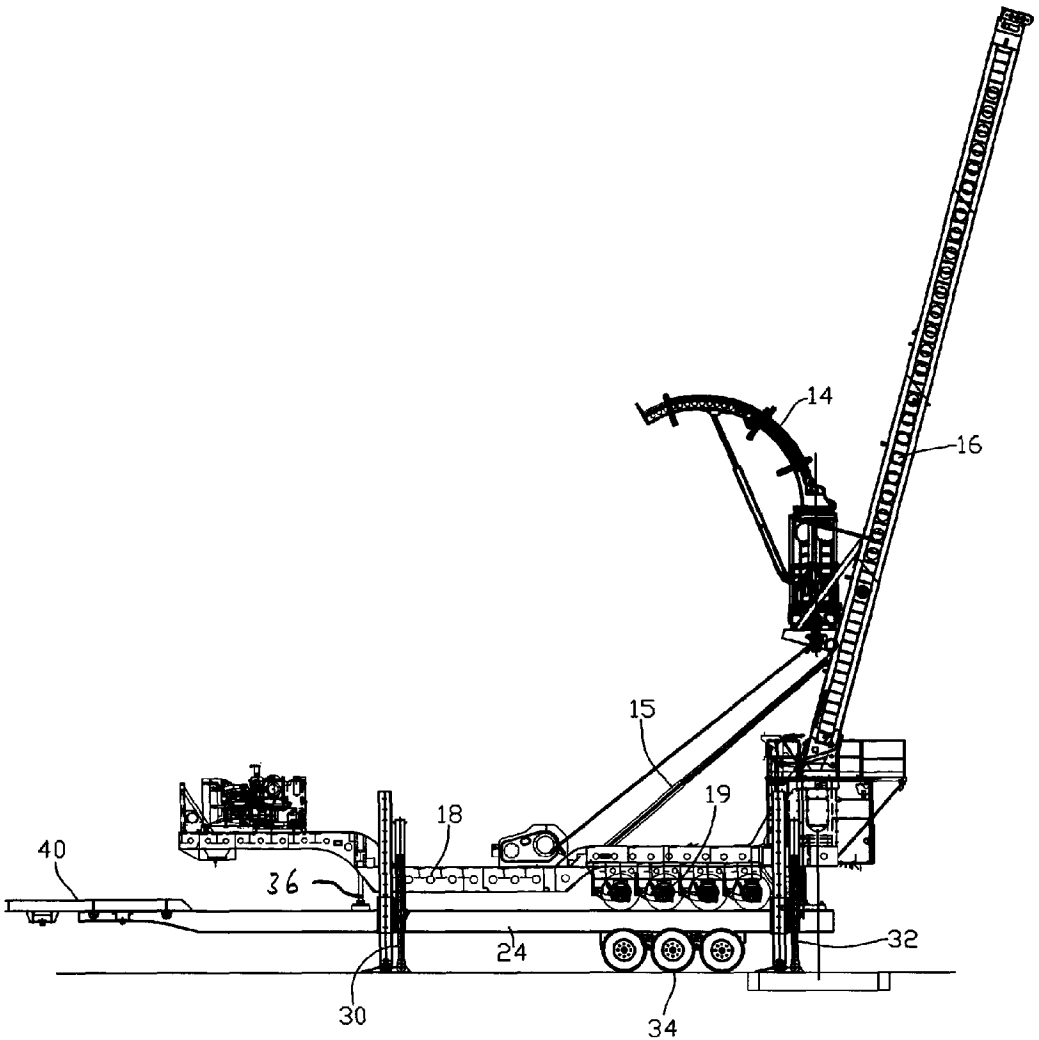
FIG. 2 is a side elevation view similar to FIG. 1 showing the coil tubing rig positioned on the carrier and the rig mast raised.

Referring now to FIG. 2, the system of FIG. 1 is shown with the tractor 20 removed and the frame 24 substantially parallel to ground. At this stage, cylinder 15 may be powered to raise mast 16 to a substantially vertical position. During this process, outriggers 30 each secured to the frame 24 are lowered so that tractor 20 can be detached from the trailer 18. The support 36 near the front of the wheeled carrier 18 is lowered to engage the frame 24 so that the wheels 19 and the lowered support 36 position the wheeled carrier in a substantially level position on the carrier trailer. Once tractor 20 has been detached, it can be moved off frame 24 and the frame 24 can be raised to a substantially horizontal position by powering the outriggers 30, 32, as shown in FIG. 2. To this end, a piston cylinder assembly 31 associated with each outrigger 30 and 32 is extended to move the frame 24 from a position shown in FIG. 1 to a substantially horizontal position as shown in FIG. 2. Once at the desired position, the outrigger may be locked in place and fluid pressure relieved to the hydraulic cylinders.

Figure 3:
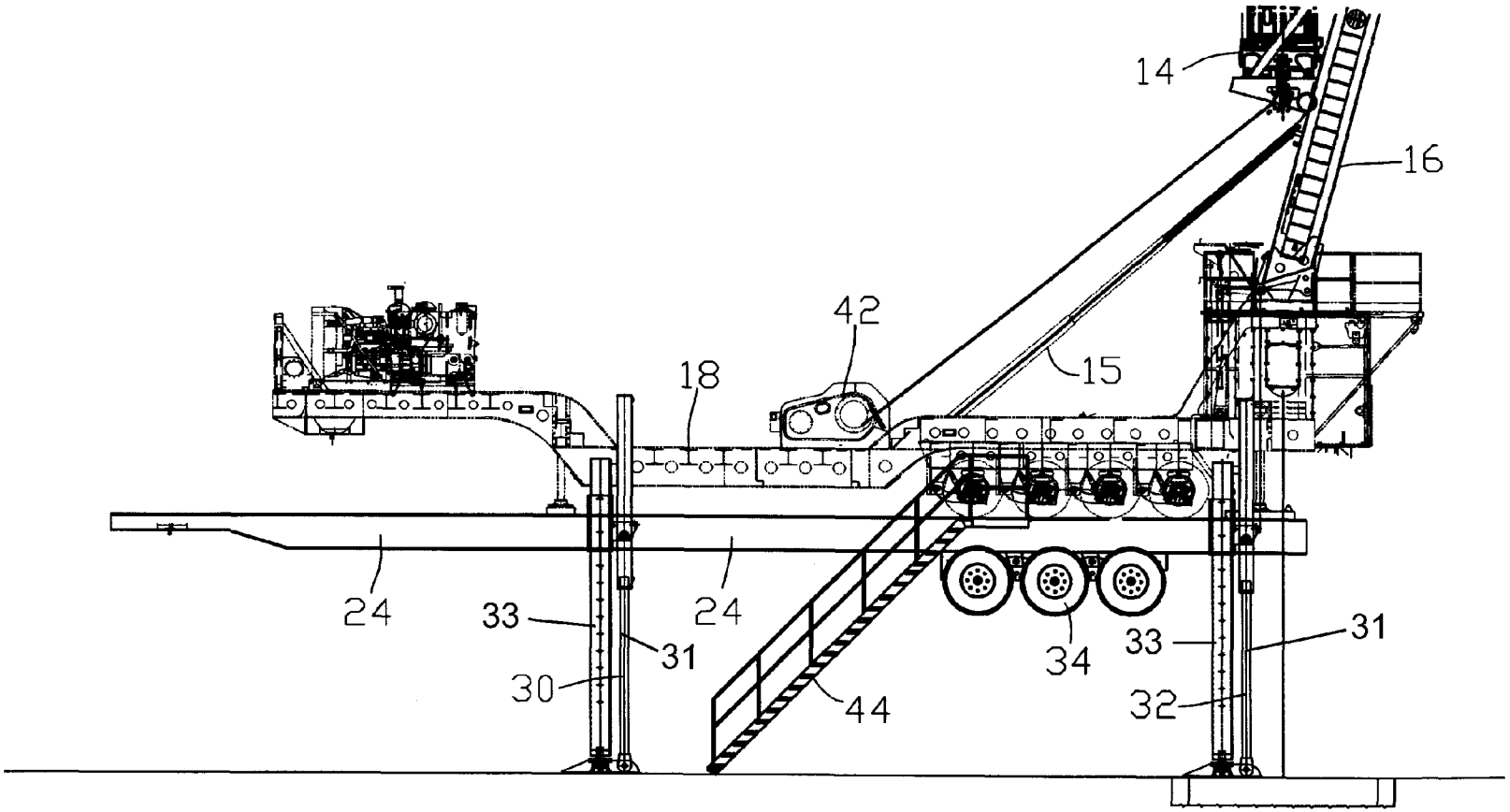
FIG. 3 is a side elevation view similar to FIG. 1 showing the rig carrier raised to the coil tubing rig operating position.

As shown in FIG. 3, the rig carrier 24 is elevated substantially above ground level. A drop-down stairs 44 may be added to facilitate rig operations. Coil tubing rig 12 may then commence operations. Mast 16 can be raised (or may previously have been raised) to a substantially vertical position generally in line with the well bore. Drawworks 42 is hydraulically powered for conducting rig operations. It should be understood with reference to FIG. 3 that a wellhead assembly comprised of a BOP and any other suitable valves necessary for drilling or re-entry work in an oil or gas well may be provided below the position of the raised trailer 18. In the FIG. 3 position, the carrier trailer may be 15 feet or more above ground level, such that the wheeled trailer 18 serves as an elevated platform for rig personnel.

Once activities have been completed at the well site and it is desired to transport the system to another site, hydraulic cylinders 31 and respective outriggers 30 and 32 may be lowered to return to the FIG. 2 positions. Tractor 20 may be backed to a position where connector 23 may be connected to wheeled trailer 18. Bed or gooseneck 22 may be a type typically used in the interconnection of truck tractors to low-boy trailers. Examples of suitable goosenecks are shown in U.S. Pat. No. 4,390,192 and references cited therein.

Figure 4:
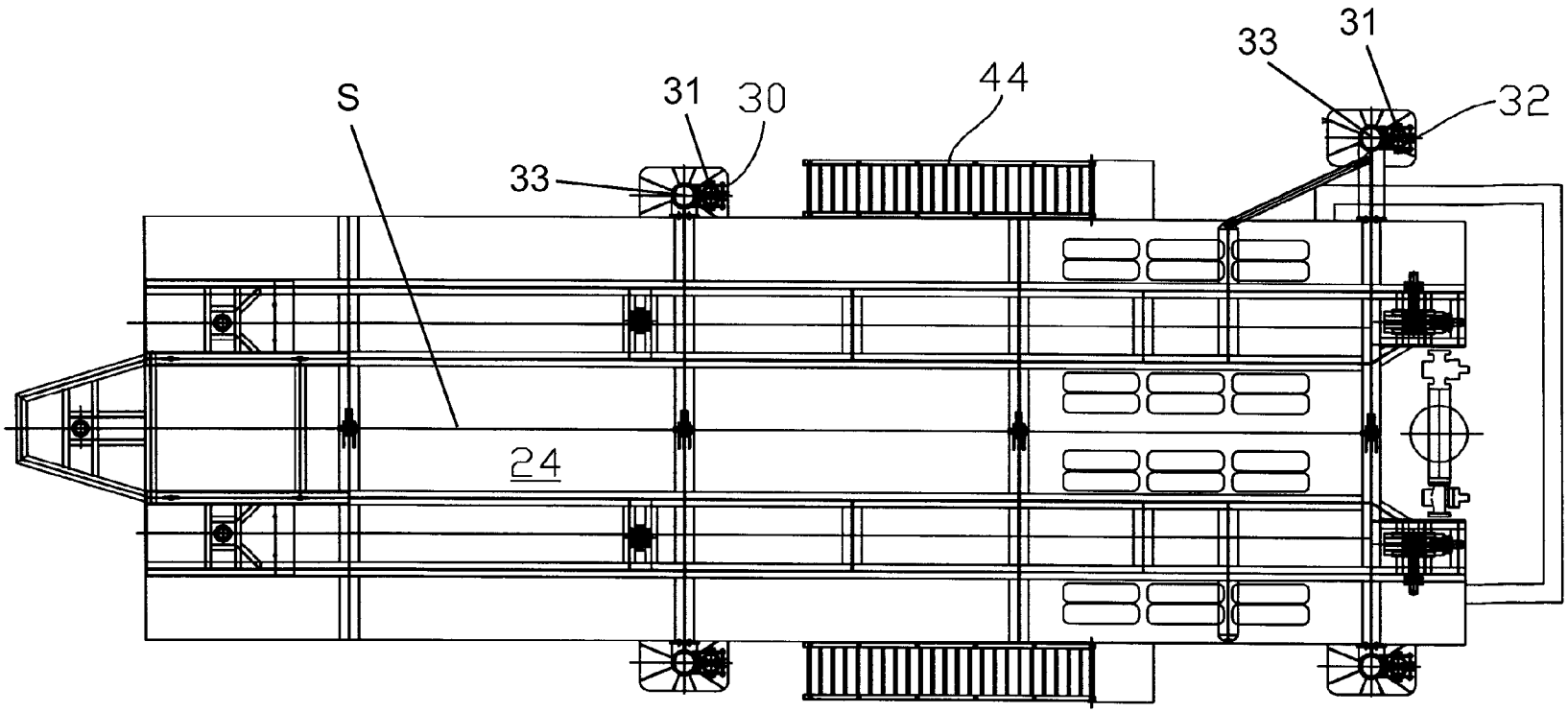
FIG. 4 is a top view of the system shown in FIG. 1.

Referring to FIG. 4, a top view of the carrier trailer shown, depicting the outriggers 30 and 32 each with hydraulic cylinder 31 and a jack stand 33. Four sets of dollies are shown in FIG. 2, and are discussed below with respect to FIGS. 5 and 6.

Figure 5:
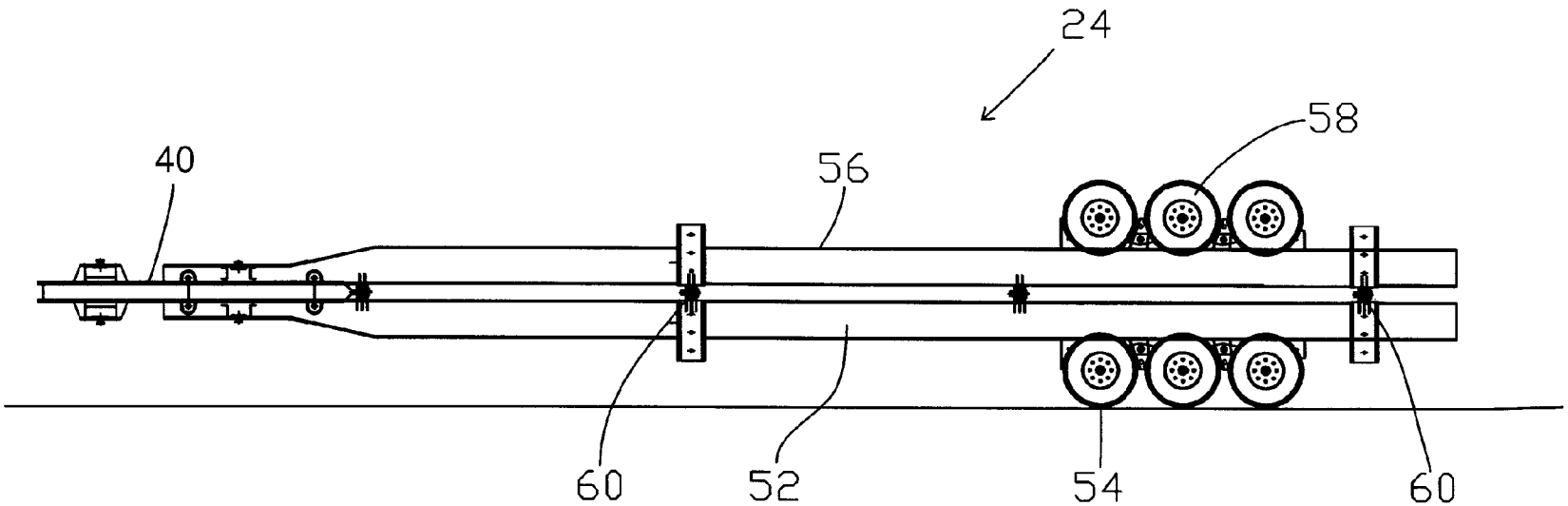
FIG. 5 is a side elevation view showing the rig carrier transported without a rig.
Figure 6:
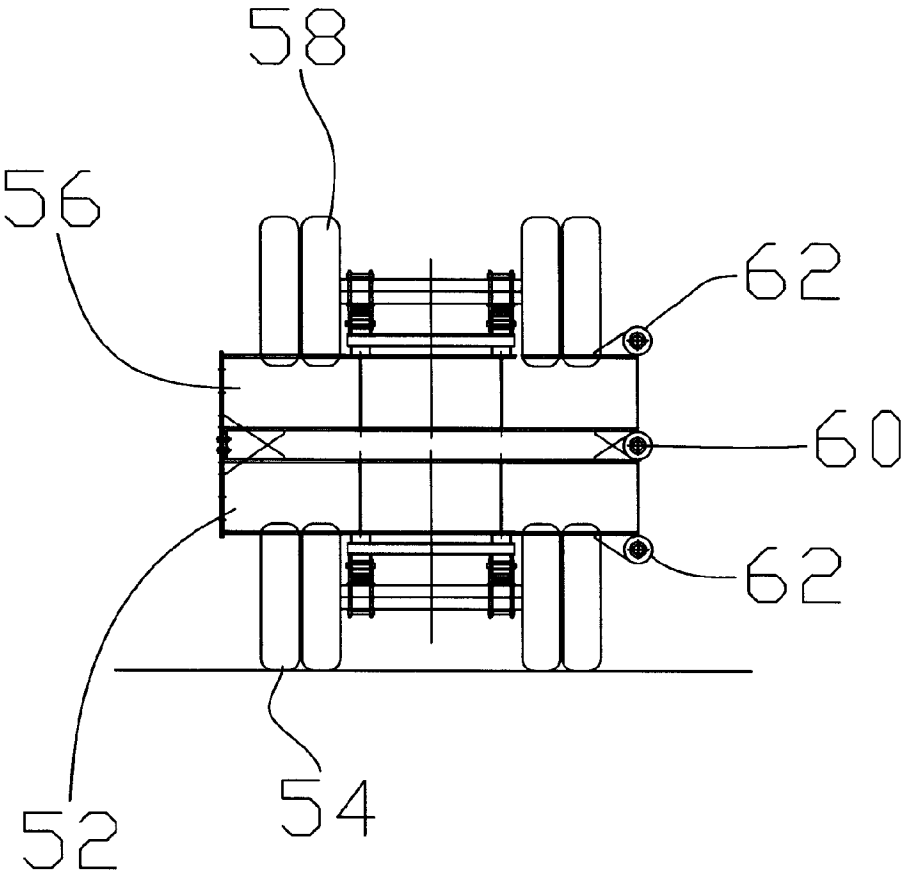
FIG. 6 is a front elevation view of the rig carrier shown in FIG. 5.

In FIG. 5, the carrier trailer is folded along a center seam S so that it has substantially one-half of its width during normal use. This allows the carrier trailer with no rig thereon to be more easily moved from one site to another down public roads. The carrier frame 24 thus consists of one side frame 52, and a mirror image side frame 56. Frame 56 is pivotally connected to frame 52 so that the side frame 56 is folded onto the top of side frame 52. Various hinge mechanism 60 are provided for this purpose. Two pairs of dollies 54 are attached to side frame 52, while the side frame 56 also has two pairs of dollies 58 attached thereto. A tongue 40 is used to interconnect the reduced width carrier trailer to a tractor or other suitable power source. FIG. 6 shows the assembly in FIG. 5 from an end view. The side frame 56 and the dollies 58 are positioned above the side frame 52 and the dollies 54. A sleeve and pin mechanism 62 may be used to maintain the frames in a side-by-side relationship as shown in FIG. 2 when in use to support a rig.

When the carrier frame is the loading/unloading position as shown in FIG. 1, the front end 25 of the frame 24 engages the ground level. A short ramp 26 with a generally triangular cross-section is provided for smoothly rolling the rig and wheeled carrier 18 onto the carrier trailer 24. This triangular ramp 26 may thus be used only for loading/unloading operations, and is not part of the frame which is elevated to a rig operating position, as shown in FIG. 3.

It should also be understood that the term "loading/unloading" is meant to encompass either a rig loading operation onto the carrier trailer 24, or a rig unloading operation from the carrier trailer 24. As disclosed herein, the rig once loaded onto the carrier frame may remain on the carrier frame and may be transported in substantially the FIG. 2 configuration from one well to another well, thereby saving valuable time which otherwise would be required to load and unload the rig and wheeled carrier from the components that elevate the rig.

A wheeled trailer as disclosed herein has a plurality of wheels, rollers, or rotating tracks for moving the rig along the surface of the carrier frame 24. The term "wheeled carrier" as used herein is thus intended to encompass each of these mechanisms for rolling the rig along the carrier frame 24.

The carrier frame as disclosed herein is a substantially rigid structure both when loading a rig onto the carrier frame and when elevating the rig to the FIG. 3 operating position. This rigid structure of the carrier frame provides a substantially planar upper surface for rolling the wheel carrier 18 onto the carrier trailer 24. Preferably the wheels for the wheeled trailer when in an operating position are positioned adjacent the rear portion of the carrier frame 24, and are directly above the dolly assembly 34 of the carrier frame.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A coil tubing system, comprising:

a wheeled carrier supporting both a coil tubing rig and a rig mast;

a trailer having a frame for selectively supporting the wheeled carrier in turn supporting both the coil tubing rig and the rig mast thereon during transit and during rig operations; and a dolly assembly including a plurality of wheels supporting the trailer.

2. A coil tubing system as defined in claim 1, wherein the trailer is substantially parallel to ground level during rig operations.

3. A coil tubing system as defined in claim 1, wherein at least one hydraulic cylinder interconnects the wheeled carrier and the rig mast for raising and lowering the rig mast.

4. A coil tubing system as defined in claim 1, wherein the dolly assembly is fixed to and inclined with the trailer when in the rig loading/unloading position.

5. A coil tubing system as defined in claim 1, wherein the trailer is foldable along a generally center seam such that one side of the trailer frame is on top of the other side of the trailer frame, thereby reducing the width of the trailer by substantially one-half during transit.

6. A coil tubing system as defined in claim 1, further comprising:

a plurality of hydraulic jacks each connected to the trailer and activated to raise and lower the trailer from a rig loading/unloading position to a rig operating position.

7. A coil tubing system as defined in claim 6, wherein the hydraulic jacks incline the trailer to a rig loading/unloading position, such that front end of the trailer is substantially at ground level while a rear end of the trailer is elevated.

8. A coil tubing system as defined in claim 7, further comprising:

a tractor for moving the wheeled carrier supporting the coil tubing rig relative to the inclined trailer when the trailer is in the rig loading/unloading position, the tractor at least partially supported on the inclined trailer during rig loading and unloading operations.

9. A coil tubing system as defined in claim 6, further comprising:

a hydraulic unit supported on the wheeled carrier for supplying power to the plurality of hydraulic jacks.

10. A coil tubing system as defined in claim 6, said trailer further comprising:

a jack stand associated with each hydraulic jack, such that the hydraulic jack raises and lowers the jack stand, which may be locked in a selected position.

11. A coil tubing system as defined in claim 6, such that in the rig operating position, the rig mast is inclined with respect to vertical such that a central injector axis of an injector supported on the rig mast is substantially aligned with a borehole.

12. A coil tubing system as defined in claim 6, wherein the trailer frame is spaced over fifteen feet above the ground level when in the rig operating position, and an injector is supported on the rig mast.

13. A coil tubing system, comprising:

a wheeled carrier supporting both a coil tubing rig and a rig mast, and a coil tubing injector supported on the rig mast when in a rig operating position;

a trailer having a frame for selectively supporting the wheeled carrier in turn supporting both the coil tubing rig and the rig mast thereon during transit and during rig operations; and a dolly assembly including a plurality of wheels supporting the trailer.

14. A coil tubing system as defined in claim 13, wherein the trailer is substantially parallel to ground level during rig operations.

15. A coil tubing system as defined in claim 13, further comprising:

a plurality of hydraulic jacks each connected to the trailer and activated to raise and lower the trailer from a rig loading/unloading position to a rig operating position.

16. A coil tubing system as defined in claim 15, wherein the hydraulic jacks incline the trailer to a rig loading/unloading position, such that front end of the trailer is substantially at ground level while a rear end of the trailer is elevated.

17. A coil tubing system as defined in claim 15, further comprising:

a hydraulic unit supported on a wheeled carrier for supplying power to the plurality of hydraulic jacks.

18. A coil tubing system as defined in claim 15, further comprising:

a jack stand associated with each hydraulic jack, such that the hydraulic jack raises and lowers the jack stand, which may be locked in a selected position.

19. A coil tubing system as defined in claim 15, wherein in the rig operating position, the rig mast is inclined with respect to vertical such that a central injector axis of the injector supported on the mast is substantially aligned with a borehole.

20. A method of using a coil tubing system, comprising:

providing a wheeled carrier supporting both a coil tubing rig and a rig mast;

providing a trailer having a frame for supporting the wheeled carrier in turn supporting both the coil tubing rig and the rig mast thereon during transit and during rig operations; and providing a doily assembly including a plurality of wheels for supporting the trailer.

21. A method as defined in claim 20, wherein the trailer is substantially parallel to ground level during rig operations.

22. A method as defined in claim 20, wherein the dolly assembly is fixed to and inclined with the trailer when in the rig loading/unloading position.

23. A method as defined in claim 20, further comprising:

providing the trailer with a plurality of hydraulic jacks; and activating the plurality of hydraulic jacks to raise and lower the trailer from a rig loading/unloading position to a rig operating position.

24. A method as defined in claim 23, wherein the hydraulic jacks incline the trailer to the rig loading/unloading position such that a front end of the trailer is substantially at ground level while a rear end of the trailer is elevated.

25. A method as defined in claim 24, further comprising:

using a tractor for moving the wheeled carrier supporting the coil tubing rig relative to the inclined trailer when in the rig loading/unloading position, the tractor at least partially supported on the inclined trailer during rig loading/unloading operations.

26. A method as defined in claim 23, wherein in the rig operating position, the rig mast is inclined with respect to vertical such that a central injector axis of an injector supported on the mast is substantially aligned with a borehole.

* * * * *